United States Patent [19]

Williams

[11] Patent Number: 4,622,913

[45] Date of Patent: Nov. 18, 1986

[54] HYDROFOIL FLAP CONTROL ROD SYSTEM

[75] Inventor: John W. Williams, Bellevue, Wash.

[73] Assignee: The Boeing Company, Seattle, Wash.

[21] Appl. No.: 649,934

[22] Filed: Sep. 13, 1984

[51] Int. Cl.[4] ..... B63B 1/28

[52] U.S. Cl. ..... 114/280; 244/232

[58] Field of Search ..... 114/275-285, 114/144 R, 144 C; 74/480 B, 502-503; 244/232

[56] References Cited

U.S. PATENT DOCUMENTS

| | | | |
|---|---|---|---|
| 3,032,377 | 5/1962 | Blase | 308/3 |
| 3,110,280 | 11/1963 | Hart et al. | 114/277 |
| 3,115,696 | 12/1963 | Evans | 29/149.5 |
| 3,132,619 | 5/1964 | Lopez | 114/66.5 |
| 3,170,432 | 2/1965 | Roper | 114/66.5 |
| 3,213,818 | 10/1965 | Barkley | 114/66.5 |
| 3,395,666 | 8/1968 | Moisdon | 114/275 |
| 3,456,609 | 7/1969 | Nott | 114/66.5 |
| 3,465,669 | 9/1969 | Doudet | 100/214 |
| 3,537,762 | 11/1970 | Lodige | 308/3 |
| 3,812,806 | 5/1974 | Korotkov | 114/66.5 |
| 3,945,268 | 3/1976 | Ion et al. | 74/502 |

*Primary Examiner*—Trygve M. Blix
*Assistant Examiner*—Jesûs D. Sotelo
*Attorney, Agent, or Firm*—Christensen, O'Connor, Johnson & Kindness

[57] ABSTRACT

A hydrofoil flap control rod system for communicating forces between an actuator and a hydrofoil flap. Guide (40), having a rectangular conduit defined by its guide surfaces (66, 72, 74 and 88), accommodates a rectangular-shaped control rod (36) upon which wear pads (42) are mounted. Simple planar machining requirements of the guide and control rod reduce the time and cost of construction of the system. One element (76) of the guide (40) is readily detached to allow lateral removal of the control rod (36) for maintenance and repair, negating the need for substantial axial clearance for rod removal.

6 Claims, 4 Drawing Figures

HYDROFOIL FLAP CONTROL ROD SYSTEM

BACKGROUND OF THE INVENTION

This invention relates to apparatus for actuating hydrofoil flaps. More particularly, this invention relates to a control rod system for transferring actuator induced forces to a hydrofoil flap.

Hydrofoil craft generally include three or more struts that extend downwardly from the hull. At the lower end of the struts, hydrofoils are fixed to extend substantially orthogonal to the struts. When the craft reaches an appropriate speed, the hydrodynamic properties of the hydrofoil cause the hull to be lifted out of the water, leaving the craft "flying" on its hydrofoils.

To control the attitude of the craft as it moves through the water, flaps are attached to the trailing edges of hydrofoils. Movement of the flaps is controlled by an actuator that is located within the hull. A control rod is connected between the actuator and the flap for communicating the push and pull forces generated by the actuator to the flap. Current hydrofoil control rod systems employ control rods having circular cross sections that are housed within cylindrical guide tubes. Spacers or bushings mounted in the guide tube support the rod within the guide tube. Proper operation of the rod within the tube requires that the rod and tube be carefully machined and assembled to maintain accurate, concentric alignment. Furthermore, once the tubes are affixed to the strut, access to the rod for replacement or repair requires axial clearance (either above or below the guide tube) that is at least equal to the length of the rod; a problematic space requirement for typical repair facilities.

SUMMARY OF THE INVENTION

This invention provides a hydrofoil control rod system for communicating forces between an actuator and a hydrofoil flap that comprises a control rod with one end connected to an actuator and the other end is connected to a hydrofoil flap. The control rod has two pairs of substantially flat, parallel side surfaces, one pair of side surfaces being substantially orthogonal to the other pair of side surfaces. Each pair of the side surfaces extend between the ends of the control rod.

Guide surfaces define a conduit through which the control rod reciprocates along its longitudinal axis. Wear pads are disposed between the control rod side surfaces and the guide surfaces to minimize direct contact between the control rod and guide surfaces.

The control rod made in accordance with this invention provides a hydrofoil control rod system that substantially simplifies machining requirements by utilizing a control rod with a rectangular cross section. Only relatively simple planar machining is necessary with such a control rod. The control rod is housed in a rectangular guide system that also substantially simplifies the machining requirements as compared to tubular-shaped guides.

This invention further provides a control rod guide system wherein one portion of the rectangular guide can be readily detached and removed, thereby creating an opening through which the control rod can be laterally removed-eliminating the axial clearance requirements of the standard designs.

In addition, the cross section of the control rod of this invention provides a favorable geometric configuration for response to loads applied to a hydrofoil and strut (and thus the control rod). Specifically, the rectangular cross section can be dimensioned to allow considerable deflection along one axis while maintaining sufficient rigidity along the other axis for responsive force communication between the actuator and the hydrofoil flap. This feature is particularly advantageous since the hydrofoil strut is subjected to considerable bending forces about its longitudinal axis in a direction roughly transverse to the line of travel of the hydrofoil craft.

DETAILED DESCRIPTION OF THE PREFERRED EMBODIMENT

Figure 1:
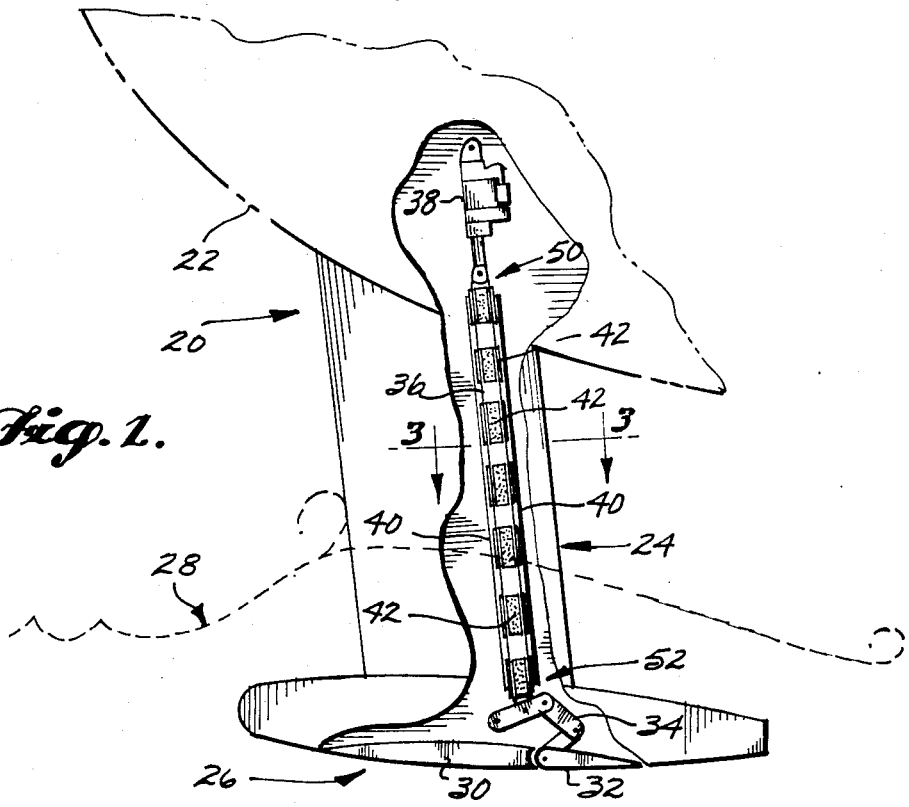
FIG. 1 illustrates the bow portion of a hydrofoil craft with a control rod system constructed in accordance with the invention being shown in cut-away view.
Figure 2:
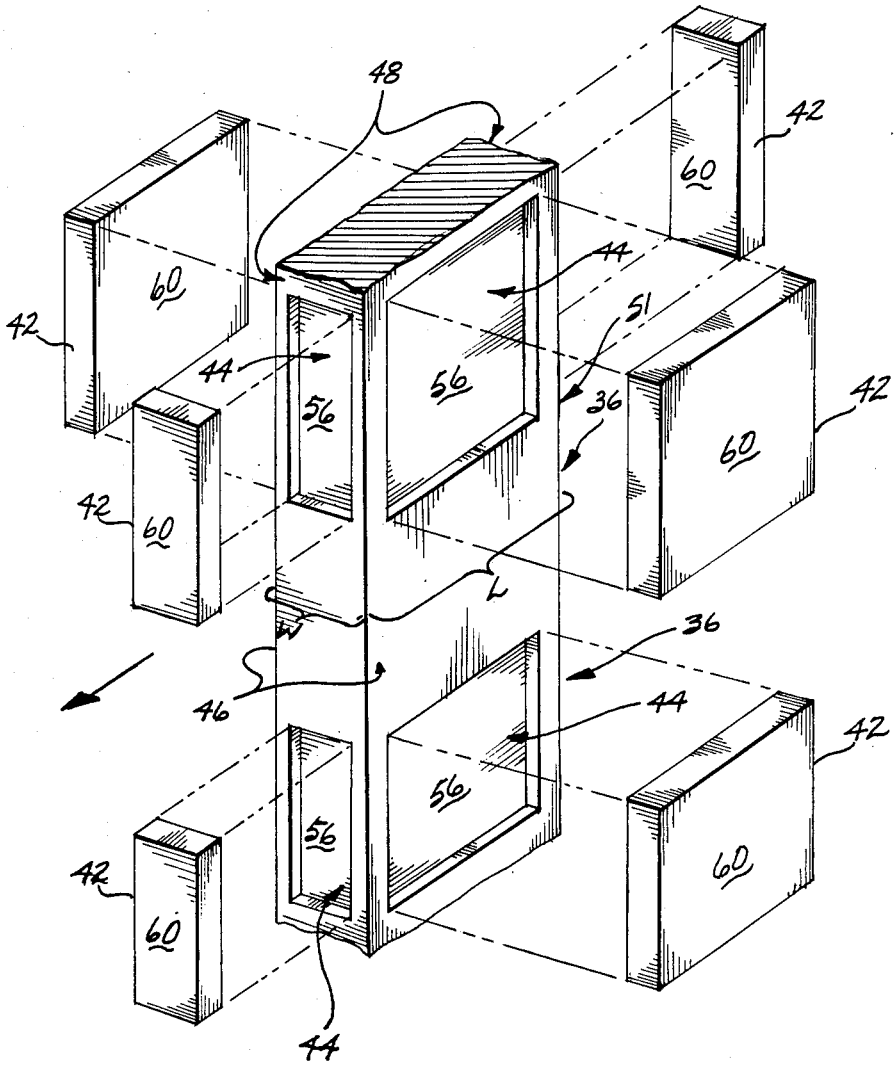
FIG. 2 is an isometric partial detail of the control rod system of FIG. 1.

With reference to FIGS. 1 and 2, the bow portion 22 of the hydrofoil craft 20 is illustrated in the "flying" position. That is, the forward motion of the craft, when combined with the hydrodynamic properties of the hydrofoil 26, causes the hull 22 and a portion of the strut 24 to rise above the surface of the water 28. The craft 20 typically is supported by a single strut 24 at the bow end and two struts at the stern (not shown). The subsequently discussed hydrofoil control rod system will be described as embodied within the forward strut 24 as shown in FIG. 1. However, the identical system also can be employed in the stern struts.

Strut 24 is attached to and depends downwardly from hull 22. At the lower end of the strut, a hydrofoil 26 is attached and extends orthogonally from the strut in a plane substantially parallel to the water surface 28. The hydrofoil 26 is comprised generally of a leading portion 30 and a trailing flap 32 that is pivotally attached to leading portion 30. Flap 32 is connected by linkage 34 to the lower end 52 of a control rod 36. The control rod 36 is substantially rectangular in cross section and extends upwardly through the strut 24, having its upper end 50 connected to a flap actuator 38 that is mounted within the hull 22.

Actuator 38 provides push and pull forces that are transmitted to the hydrofoil flap 32 by the control rod 36 to deflect hydrofoil flap 32 and thereby control the attitude of the hydrofoil craft 20 as it moves through the water. Lateral stabilization of the control rod 36 is provided by a control rod guide 40 that extends between the actuator 38 and the linkage 34 to surround and house control rod 36. Wear pads 42 reside within recesses 44 that are formed at spaced locations along all four sides of control rod 36. The flat outermost faces of the wear pads 42 contact the inner walls of control rod guide 40 and slide along the walls as control rod 36 reciprocates within the guide. The wear pads are formed of low-friction material of sufficient density to resist crushing.

Figure 3:
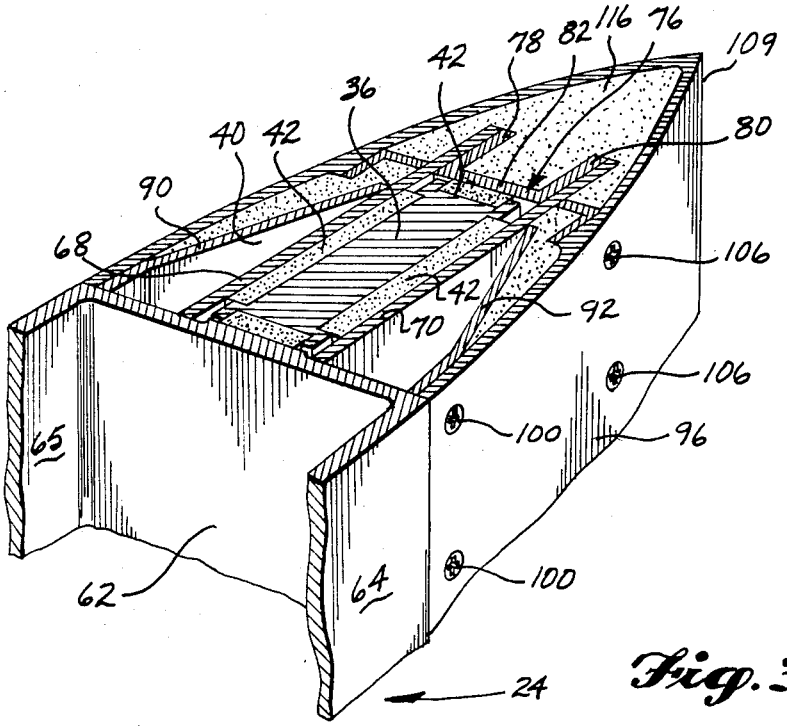
FIG. 3 is an isometric, cross-sectional view of the control rod system taken along lines 3—3 of FIG. 1.
Figure 4:
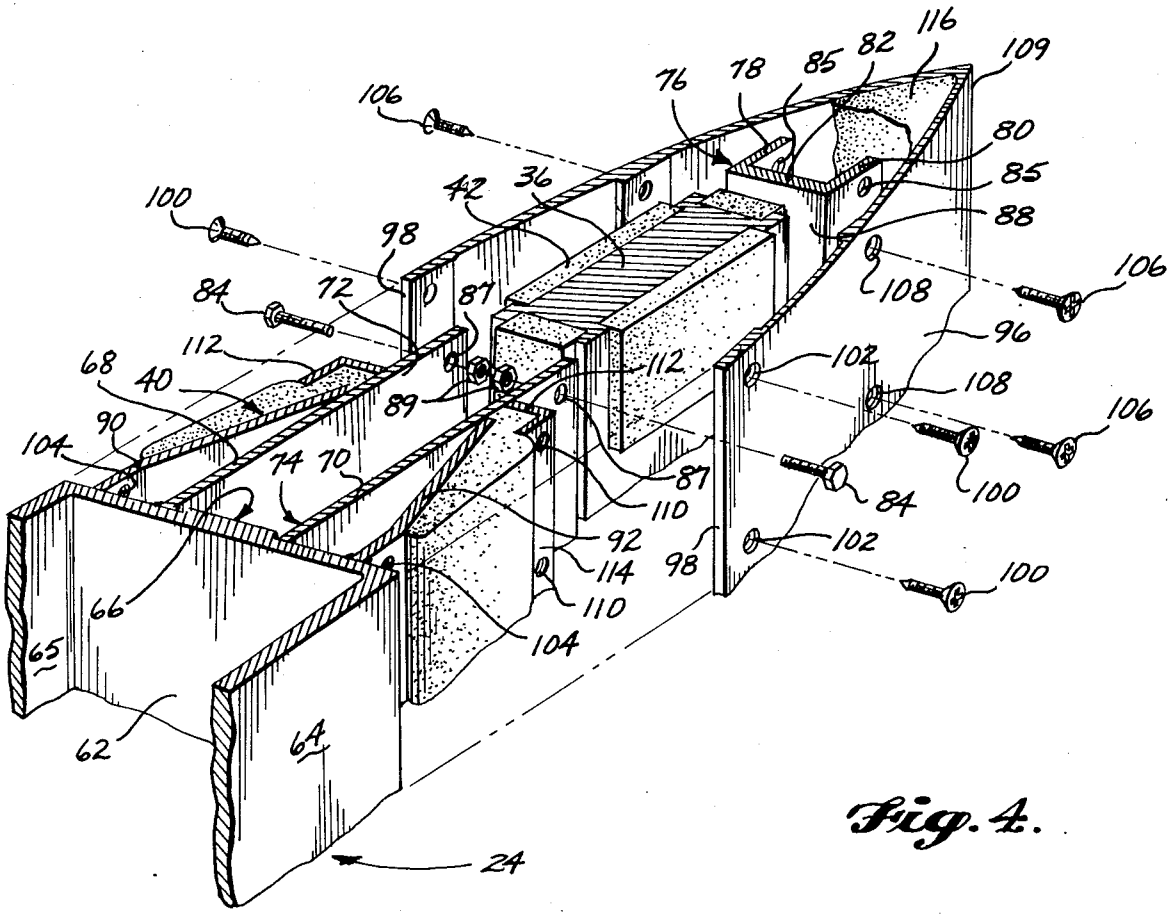
FIG. 4 is a partially exploded cross-sectional view of the portion of the control rod system that is depicted in FIG. 3.

The details of the currently preferred embodiment of the invention can be understood with reference to FIGS. 2, 3 and 4. In this embodiment the control rod 36 is rectangular, having a first pair of parallel side surfaces 46 orthogonally disposed to a second pair of parallel side surfaces 48. Each side surface is substantially flat, and extends between the control rod upper and lower ends 50 and 52. The planar machining requirements of such a shaped rod are appreciably simpler than that required for prior art cylindrical control rods that are housed within cylindrical guide tubes. The recesses 44 are rectangular, having inner surfaces 56 that are substantially parallel to the side surfaces (46 or 48) of the control rod in which the particular recess is formed. Low-friction wear pads 42 reside within the recesses 44. The wear pads 42 are substantially flat and of a thickness slightly greater than the depth of the recesses 44 so that the outer faces 60 of the wear pads 42 are parallel to the side of the control rod to which they are mounted and contact the interior walls of control rod guide 40.

As best shown in FIGS. 3 and 4, the guide 40 of the depicted embodiment is located near the trailing end of the strut 24. In this arrangement, the two side members 64 and 65 of strut 24 are joined near the trailing end by a substantially flat web 62 that extends between and is substantially orthogonal to the sides of the strut. The web 62 is proximal to the trailing edge portion of the strut and extends along the length of the strut between the actuator 38 and linkage 34.

Spaced apart parallel guide plates 68 and 70 extend orthogonally outward from web 62 along its length. In the practice of the invention, the facing surfaces 72 and 74 of the guide plates are machined to ensure that the distance between the surfaces 72 and 74 is substantially constant throughout the width and length of the guide plates 68 and 70. The control rod 36, including pads 42, resides within the space between guide plates 68 and 70 with the first pair of side surfaces 46 of the control rod 36 being adjacent to and parallel with the guide surfaces 72 and 74.

When inserted between guide plates 68 and 70, one surface of the second pair of control rod side surfaces 48 is located adjacent to the web 62. As is best illustrated in FIG. 4, the web 62 includes a protruding portion 66 that extends rearwardly between the spaced apart inner surfaces of the guide plates 68 and 70. The face of the protruding portion 66 of the web is machined to form a flat guide surface that is parallel to the adjacently positioned side surface of control rod 36.

Guide 40 is essentially complete when a keeper element 76 is fastened between the outer edges of the guide plates 68 and 70. The keeper element is an elongate channel-shaped structure having flanges 78 and 80 connected by a web 82. The flanges 78 and 80 are spaced apart and lie parallel with and between the guide plates 68 and 70. The flanges of keeper element 76 have holes 85 drilled at spaced-apart locations along their lengths. These holes 85 are aligned with corresponding holes 87 in the outer edges of the guide plates 68 and 70. Bolts 84 pass through holes 85 and 87 to mate with nuts 89, thereby securing keeper element 76 between the outer edges of guide plates 68 and 70. The surface of the keeper web 82 that faces inwardly (toward the center of the strut) is machined to form a guide surface 88 that is parallel to and spaced apart from the guide surface of the protruding portion 66 of the strut web 62 when keeper element 76 is installed in the described manner. When the keeper element 76 is installed, the rearmost surface of the second pair of control rod side surfaces 48 are adjacent to and parallel with guide surface 88 of the keeper web 82.

In summary, the guide surface of the protruding portion 66 of the web 62, the guide surfaces 72 and 74 of the parallel guide plates 68 and 70, and the guide surface 88 of the keeper web 82 are positioned to form a rectangular conduit into which control rod 36 (including pads 42) is installed. As pointed out earlier, the requirement for smooth, nonbinding reciprocation of the control rod is met by relatively simple planar machining of the control rod surfaces and the guide surfaces.

An alternative embodiment of guide 40 could feature rectangular recesses (not shown) formed in the guide surfaces 72 and 74 of the parallel guide plates 68 and 70, and also formed in the protruding portion 66 of web 62 and guide surface 88 of the keeper web 82. These recesses could accommodate wear pads 42, which would function precisely as earlier described, while obviating the need for recesses 44 to be formed in control rod 36.

Continuing with the description of the depicted guide 40, the guide plates 68 and 70 are stabilized by two braces 90 and 92. Each brace is a plate having one end welded or otherwise affixed to the web 62 near the junction of the web and a side 64 or 65 of the strut 24. The braces 90 and 92 extend orthogonally outward from the web for a short distance and then angle inwardly with the outer edges of braces 90 and 92 being welded or otherwise affixed to the guide plates 68 and 70 at a position near keeper web 82.

In addition to bracing guideplates 68 and 70, the braces 90 and 92 provide mounting surfaces for attaching a trailing cuff 96, which encloses the control rod system and completes the trailing edge contour of the strut 24. Cuff 96 is essentially V-shaped in cross section and is positioned with the edges of the two legs thereof abutting the rearwardly facing edges of strut sides 64 and 65. Threaded fasteners 100 pass through apertures 102 at spaced-apart locations near the edges 98 of the cuff 96. Fasteners 100 engage threaded holes 104 that are formed in the portion of the braces 90 and 92 that extend orthogonally from the web 82.

In the depicted embodiment, cuff 96 is further secured by additional threaded fasteners 106 that pass through apertures 108 that are approximately midway between the edges 98 and the trailing end point 109 of cuff 96 and are spaced apart from one another along the length of the cuff. Fasteners 106 engage threaded holes 110 in supports 112 that are fixed to guide plates 68 and 70. The supports 112 are essentially L-shaped members having one leg fixed at one edge to the guide plate (68, 70) so that the other leg of each support 112 presents a surface 114 which is substantially parallel to the guide plate and includes threaded holes 110.

Polymeric foam 116 is utilized to fill the spaces between the guide 40 and the cuff 96. The foam 116 provides support for the cuff 96 when the cuff is fastened in place.

With particular reference to FIG. 4, the removal of the control rod for maintenance or repair can best be described. Access to the control rod 36 is accomplished by removing the fasteners 100 and 106 that hold cuff 96 in place. Once the cuff is removed, the keeper element 76 can be readily detached from the rest of the guide 40 by removal of the bolts 84 that secure it to the guide plates 68 and 70. With the keeper element 76 removed, the control rod 36 can be disengaged from the guide plates by lateral movement of the control rod away from web 62. Thus, in contrast with the prior art, the control rod 36 need not be removed longitudinally through its guide and removal does not require considerable axial clearance either above or below the strut. It is pointed out, however, that if longitudinal removal of the rod is desirable, this invention is also amenable to such removal.

Another significant advantage to using a rectangular-shaped control rod resides in the fact that its cross-sectional dimensions can be established to suit both axial and lateral stiffness requirements. Specfically, with reference to FIG. 2, the width W and length L of the control rod cross section can be established so that the rod will be relatively flexible in one direction. For example, the arrow in FIG. 2 shows the direction of travel of the hydrofoil craft with respect to the control rod 36. Typically, the craft's turning maneuvers cause the strut and thus control rod 36 to be subject to bending forces that act in a direction transverse to the direction of travel. The width W of the control rod can be optimally designed to allow the control rod to flex in response to the lateral bending load without buckling. Minimizing the distance between pads 42 along the first pair of side surfaces 46 of the control rod will also aid to prevent buckling failure of the control rod when width W is minimized.

The length L of the control rod can be selected to provide the area necessary for bearing the axial forces induced by the actuator. This design freedom is not available with circular cross sections of conventional control rods.

While the invention has been described with reference to a preferred embodiment, it is clearly understood by those skilled in the art that the invention is not limited thereto. Rather, the scope of the invention is to be interpreted only in conjunction with the appended claims.

The embodiments of the invention in which an exclusive property or privilege is claimed are defined as follows:

1. A hydrofoil flap control rod system for communicating forces between an actuator and a hydrofoil flap, comprising:

(a) a control rod having a first end and a second end, the first end connected to the actuator, the second end connected to the hydrofoil flap, the control rod having first and second pairs of substantially flat side surfaces, each pair of the side surfaces extending between the first end and the second end of the control rod; and (b) guide means for guiding the control rod for reciprocal movement along the longitudinal axis of the control rod, the guide means including:

(i) a strut member extending between the actuator and the hydrofoil flap, the strut member having at least one substantially flat longitudinal guide surface;

(ii) two guide plates affixed to the longitudinal guide surface of the strut member, the guide plates extending along the strut member substantially between the actuator and the hydrofoil, each guide plate having a substantially flat guide surface, the guide plates being affixed to the longitudinal guide surface so that the guide surfaces of the guide plates are spaced apart and facing each other;

(iii) a keeper element removably attached to the guide plates, the keeper element having a substantially flat guide surface, the keeper guide surface being spaced apart from and facing the longitudinal guide surface of the strut member, the guide surfaces of the guide plates, the keeper guide surface, and the longitudinal guide surface of the strut member forming a conduit between the actuator and the hydrofoil flap, the control rod extending through the conduit with each side of the control rod being substantially parallel to an adjacent guide surface.

2. The hydrofoil flap control rod system of claim 1, further comprising wear pads disposed between the side surfaces of the control rod and the guide means for minimizing direct contact between the control rod and the guide means.

3. The hydrofoil flap control rod system of claim 2, wherein the wear pads reside in recesses formed in the side surfaces of the control rod.

4. The hydrofoil flap control rod system of claim 3, wherein the control rod is rectangular shaped.

5. The hydrofoil flap control rod system of claim 1, further comprising wear pads residing in recesses formed in the guide surfaces of the guide plates, the keeper guide surface, and the longitudinal guide surface of the strut member.

6. The hydrofoil flap control rod system of claim 1 further including access means for allowing lateral movement of the control rod away from the guide means when the control rod is disconnected from the actuator and flap.

* * * * *